United States Patent [19]

Kumano et al.

[11] Patent Number: 4,734,346

[45] Date of Patent: Mar. 29, 1988

[54] PHOTOSENSITIVE MATERIAL FOR ELECTROPHOTOGRAPHY

[75] Inventors: Masafumi Kumano, Sendai; Koichi Haga, Ohgawara; Yasuyuki Shindoh, Sendai, all of Japan

[73] Assignees: Ricoh Co., Ltd.; Ricoh Research Institute of General Electronics Co., Ltd., both of Tokyo, Japan

[21] Appl. No.: 860,714

[22] Filed: May 7, 1986

[30] Foreign Application Priority Data

May 17, 1985 [JP] Japan ..... 60-106347

[51] Int. Cl.[4] ..... G03G 5/082

[52] U.S. Cl. ..... 430/56; 430/84; 430/95

[58] Field of Search ..... 430/57, 60, 65, 95, 430/84

[56] References Cited

U.S. PATENT DOCUMENTS

| | | | |
|---|---|---|---|
| 4,526,849 | 7/1985 | van der Voort et al. | 430/57 |
| 4,568,622 | 2/1986 | Minami et al. | 430/135 |
| 4,582,770 | 4/1986 | Yamazaki | 430/57 |
| 4,598,031 | 7/1986 | Yamazaki | 430/57 |

*Primary Examiner*—John L. Goodrow

*Attorney, Agent, or Firm*—Flynn, Thiel, Boutell & Tanis

[57] ABSTRACT

The present invention is concerned with a photosensitive material for electrophotography that comprises forming a photosensitive layer on a substrate, wherein said photosensitive layer is constructed by laminating a charge transfer layer, a first charge carrier generating layer and a second charge carrier generating layer in order from said substrate side to free surface, and said charge transfer layer and second charge carrier generating layer each has a band gap wider than that of said first charge carrier generating layer.

12 Claims, 12 Drawing Figures

PHOTOSENSITIVE MATERIAL FOR ELECTROPHOTOGRAPHY

BACKGROUND OF THE INVENTION (a) Field of the Invention

The present invention relates to a photosensitive material for electrophotography and, in particular relates to an amorphous silicon system photosensitive material for electrophotography wherein a photoconductive layer comprises a lamination of three layers, each of which has a specified function.

(b) Description of the Prior Art

The photoconductive materials for the electrophotographic element usually have been inorganic materials such as Se, ZnO, CdS and the like and organic materials such as poly-N-vinylcarbazole, trinitrofluorenone and the like, and amorphous silicon(a-Si) has recently come to attract public attention. Amorphous silicon not only is possessed of characteristics being equal to the conventional Se photosensitive material but is superior in respect to safety, durability and the like against the environment.

The electrophotographic photosensitive materials have been demanded to satisfy collective characteristics such as chargeability in the dark, sensitivity at the time of light radiation, residual potential at the time of repetitive use and the like, and further have been demanded from various respects to have the physcial properties inherent in the photoconductive materials per se to decide these electrophotographic characteristics.

However, it is difficult for a single photoconductive material to satisfy every requirement completely. Therefore, it has been tried to improve the electrophotographic characteristics by providing a layer structure of a photosensitive layer using plural photoconductive materials, combining a photosensitive layer with a high resistance layer or the like.

In addition to the principal organic photoconductive materials, there have been proposed various other photoconductive materials, for instance, those used mainly as a functional partition type photosensitive layer that comprise the combination of a charge carrier generating layer that generates charge carriers on the radiation of light, a charge transfer layer that transfers said charge carriers and those used for each of these layers.

Further, since it is demanded that a photosensitive layer as a whole to have a high dark resistance, it has been proposed to make an amorphous silicon system electrophotographic photosensitive element highly resistive. As the methods therefor, there have been proposed:

(a) a method for making a photosensitive layer as a whole have a high resistance of $10^{14}$ Ωcm or more by providing blocking layers on both sides of said photosensitive layer; and (b) a method for attaining a high resistance of $10^{13}$–$10^{14}$ Ωcm or more by incorporating oxygen, carbon and nitrogen atoms in an a-Si layer and rendering said layer photoconductive.

In the above method (a), as shown in FIG. 11, the charged potential, constituting one important factor of the electrophotographic characteristics, is held by upper and lower blocking layers 45, 47, and and a-Si layer (photosensitive layer) 43 free from oxygen, carbon and nitrogen atoms is used as a charge carrier generating layer that generates charge carriers on incidence of light. In this figure, the reference numeral 41 stands for a substrate. As the materials for of this blocking layer, there are used high resistance materials such as metal oxides, organic matters and the like in addition to a-Si containing oxygen, carbon and nitrogen atoms. These blocking layer materials display either an electrical insulating property or a non-photoconductive property (which see Japanese Laid-open Patent Application No. 52178/1982 Specification).

In this instance, it has also been considered to form the blocking layer by endowing the a-Si layer (charge carrier generating layer) and the blocking layer materials with counter semiconductivity (for instance P-N junction, N-P junction and the like) in relation to those layers, and to use various metal materials in the substrate for forming a Schottky barrier between it and the layer thereon. According to the method (a) mentioned above, however, there is no way for improving the characteristics of the blocking layer in order to control the charged potential of the electrophotographic photosensitive element, and accordingly process control of the electrophotographic characteristics becomes difficult because the way of obtaining a desired electrophotographic element by changing the film thickness of the photosensitive layer can not be employed as usual. When a high resistant material is used in the blocking layer, there are brought about defective electric characteristics such as rise in residual potential, fall in repetition characteristics and the like because this material is non-photoconductive or electrically insulating, and so the carriers generated by the photosensitive layer are trapped within or by the interface of the blocking layer.

On the other hand, in the above method (b), as shown in FIG. 12, a photosensitive layer 43 comprising adding oxygen, nitrogen and carbon atoms to an a-Si layer is formed on a substrate 41 in order to hold the charged potential. And, both a blocking layer 45 and a protective layer 49 are also allotted a part in improving the chargeability (which see Japanese Laid-open Patent Application No. 115553/1982 Specification). According to this method, control of the charged potential can be effected readily by changing the film thickness of the a-Si layer 43, but it is difficult to improve both the photosensitivity and the chargeability simultaneously. Therefore, more improvement has been demanded.

SUMMARY OF THE INVENTION

The present invention aims at provision of a photosensitive material for electrophotography that can improve both the photosensitivety and the chargeability simultaneously.

Further, the present invention aims at more improving the photosensitivity and simultaneously reducing the residual potential at the time of repetitive use in said photosensitive material.

Still further, the present invention provides an a-Si system photosensitive material for electrophotography that is superior in both photosensitivity and chargeability.

The above objects can be achieved by providing a photosensitive material for electrophotography that comprises forming a photosensitive layer on a substrate, wherein said photosensitive layer is constructed by laminating a charge transfer layer, a first charge carrier generating layer and a second charge carrier generating layer in order from said substrate side to free surface side, and said charge transfer layer and second charge carrier generating layer each has a band gap larger than that of said first charge carrier generating layer.

One characteristic of the present invention consists in said photosensitive material for electrophotography wherein the band of said each layer is constructed to have a substantially equal energy from the band end of valence band to the Fermi level.

Another characteristic of the present invention consists in said photosensitive material for electrophotography wherein said charge transfer layer, first charge carrier generating layer and second charge carrier generating layer are each formed of a noncrystal silicon layer that contains at least one member of hydrogen atoms, heavy hydrogen atoms or halogen atoms, is constructed of a noncrystal material consisted mainly of silicon atoms and exhibits a photoconductivity, and the charge transfer layer and the second charge carrier generating layer of those layers further contain oxygen atoms and nitrogen atoms as constituent atoms.

DETAILED DESCRIPTION OF THE INVENTION

Figure 1:
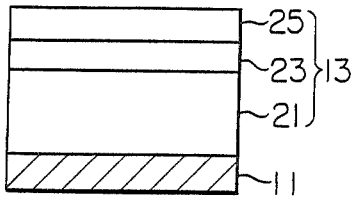
FIG. 1 is a sectional view showing the construction example of the photosensitive layer of the photosensitive material for electrophotography according to the present invention.

The first invention of the present application relates to a photosensitive material for electrophotography that comprises forming a photosensitive layer on a substrate, wherein said photosensitive layer is constructed by laminating a charge transfer layer, a first charge carrier generating layer and a second charge carrier generating layer in order from said substrate side to free surface side, and said charge transfer layer and second charge carrier generating layer each has a band gap larger than that of said first charge carrier generating layer.

In the photosensitive material for electrophotography of this first invention, the charge carriers generated by the first and second charge carrier generating layers on radiation of light are transferred by the charge transfer layer and thus the charge carriers are compensated. At this time, the photosensitive material for electrophotography as a whole is improved in the chargeability of charge carriers because the band gap of the charge transfer layer on the substrate side and the band gap of the second charge carrier generating layer on the free surface side are widened relatively. On the other hand, the charge carrier generating layer as a whole can generate high charge carriers on the average covering the wide wavelength region and is improved in sensitivity because the first charge carrier generating layer held between both is designed to have a relatively narrow band gap so as to be photosensitive to the long wavelength side, and the second charge carrier generating layer is photosensitive to the short wavelength side.

The third invention of the present application relates to improvements in the above first invention, namely the further defined a-Si system photosensitive material.

That is, the third invention of the present application relates to the photosensitive material according to said first invention, wherein the charge transfer layer, the first charge carrier generating layer and the second charge carrier generating layer are each formed of an amorphous silicon layer that contains at least one member of hydrogen atoms, heavy hydrogen atoms or halogen atoms and consists mainly of silicon atoms, and the charge transfer layer and the second charge carrier generating layer of those layers further contain oxygen atoms and nitrogen atoms as constituent atoms.

The conventional a-Si film (photosensitive layer) has been added with hydrogen atoms, heavy hydrogen atoms or halogen atoms for the purpose of lowering the local level density. However, the inventors of the present application have confirmed that the addition of dopants other than those raises the local level density and lowers the photoconductivity, and have further confirmed that in case the a-Si film is divided into a charge carrier generating layer and a charge transfer layer, said charge carrier generating layer is further made to take a two-layer structure (the a-Si film as a whole takes a three-layer structure), one layer of said charge carrier generating layer is added with hydrogen atoms and the like so as to have the highest photoconductivity that the a-Si film can, and another layer of said charge carrier generating layer is endowed with a high photoconductivity while widening the optical forbidden band by adding oxygen atoms and nitrogen atoms besides hydrogen atoms and the like, a flat spectral sensitivity may be obtained in the visible light region by said two-layered charge carrier generating layer and further the carriers generated by the charge carrier generating layer may be transferred efficiently by the charge transfer layer; and in case this charge transfer layer is made highly resistant by adding oxygen atoms and nitrogen atoms besides hydrogen and the like so as to hold the charged potential, the photosensitive material for electrophotography as a whole may obtain an average high photoconductivity throughout the visible light region and a high charged potential can be held.

The photosensitive material for electrophotography according to the second invention of the present application is the one that has further enhanced the photosensitivity in the aforesaid first invention as well as improved the residual potential characteristic.

That is, the second invention of the present application relates to the above mentioned photosensitive material for electrophotography according to the first invention wherein the band structure of each layer of the photosensitive layer comprising the charge transfer layer, the first charge carrier generating layer and the second charge carrier generating layer has been designed so that the energy from the band end of the valence band to the Fermi level is substantially equal.

By enlarging the band gap of the charge transfer layer on the substrate side and the band gap of the second charge carrier generating layer on the free surface side of the photosensitive layer, the charged potential is surely enhanced, but a bad influence is exerted on the sensitivity owing to the formation of a double heterojunction. In order to form an electrostatic image, it becomes necessary that the electron-hole pair generated by radiation of light transfer onto the surface of the photosensitive layer and the conductive substrate respectively so as to compensate the potential charged on the surface of the photosensitive layer by corona discharge or the like and the antipotential on the substrate accompanied thereby. At this time, the electron or hole is captured in the interface (heterojunction portion) of layers by the band gap difference or further captured by the level difference of the band gap, or is re-combined. In case the electron-hole pair generated by radiation of light is not utilized effectively as mentioned above, the sensitivity deteriorates, and the residual potential is increased by the captured electron or hole, whereby the characteristics required for the electrophotographic photosensitive material come to deteriorate.

Figure 2:
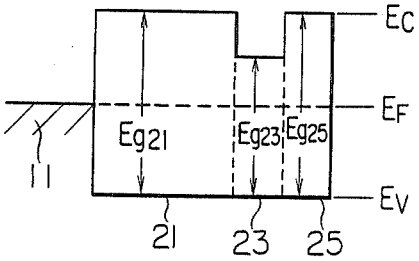
FIG. 2 is a view showing its energy band.

FIG. 1 is a sectional view showing the construction example of the photosensitive layer of the photosensitive material for electrophotography according to the present invention, wherein a photosensitive layer 13 is formed on a substrate 11. The photosensitive layer 13 is comprised of three layers, namely a charge transfer layer 21, a first charge carrier generating layer 23 and a second charge carrier generating layer 25, from the substrate side to the free surface side. As shown in FIG. 2, the band gap $Eg_{21}$ (Ec-Ev) of the charge transfer layer 21 and the band gap $Eg_{25}$ of the charge carrier generating layer 25 wider than the band gap $Eg_{23}$ of the first charge carrier generating layer 23, and form a double heterojunction. The energy ($E_F-E_v$) from the band end of the valence band to the Fermi level $E_F$ is equal in all cases of the charge transfer layer 25, the first charge carrier generating layer 21 and the second charge carrier generating layer 23, and the band end of the valence band is made smooth throughout the photosensitive layer 13. There is shown above the instance where the band gap $Eg_{21}$ of the charge transfer layer 21 and the band gap $Eg_{25}$ of the second charge carrier generating layer 25 are equal, but both may be different.

Explanation will be made by citing the instance of forming an electrostatic latent image by charging this electrophotographic photosensitive material positively.

Figure 3:
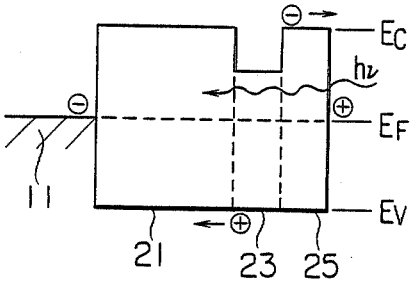
FIG. 3 is a model view showing the process of formation of an electrostatic image in the photosensitive material for electrophotography according to the present invention.

As shown in FIG. 3, in case this photosensitive material is subjected to corona discharge or the like in the dark, positive electric charge is electrified on the second charge carrier generating layer 25, while negative electric charge is caused on the substrate 11 side correspondingly. At this time, since the second charge carrier generating layer 25 is provided with a relatively high band gap, a high dark resistance can be realized and the charge can be held on the second charge carrier generating layer 25 with superior charging characteristics. Likewise, negative charge is hold on the interface of the charge transfer layer 21 and the substrate 11. In case the radiation of light is made selectively in order to form an electrostatic image, electron-hole pairs are generated on the first charge carrier generating layer 23 and the second charge carrier generating layer 25. At this time, since the band gap of the first charge carrier generating layer 23 is smaller than that of the second charge carrier generating layer 25, the first charge carrier generating layer 23 is more sensitive to the long wavelength side than the second charge carrier generating layer 25 and can utilize the energy of radiated light effectively. The electron and hole generated here transfer toward the positive potential on the surface of the photosensitive layer 13 and the negative potential on the substrate 11 respectively. At this time, the transfer distance of the hole is naturally longer than that of the electron. However, as the band end of the valence band has no level difference and smooth, the hole is prevented from being captured during its transfer. Further, as re-combination does not substantially take place and no depletion layer exists, the hole produced by the radiation of light transfers quickly toward the conductive substrate to thereby compensate the negative potential on the conductive substrate 11 efficiently. Consequently, a high photosensitivity is obtained as well as a residual potential is suppressed to better an image contrast.

Next, the present invention will be explained in more detail along the instance of having used an amorphous silicon (a-Si) as a photoconductive material.

Figure 4:
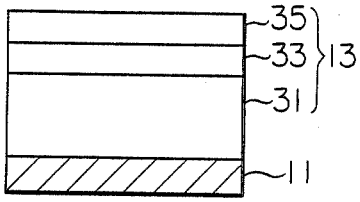
FIG. 4 is a schematic sectional view showing the layer structure example of the a-Si system photosensitive material according to the present invention.

FIG. 4 is a sectional view showing the structure example of the a-Si system electrophotographic photosensitive material, wherein a photosensitive layer 13 is formed by laminating, on a substrate 11, a charge transfer layer 31, a first charge carrier generating layer 33 and a second charge carrier generating layer 35 in order.

As the substrate 11 there may be used either an electrically conductive material or an electrically insulating material. Said electrically conductive material includes metals such a stainless steel, Ni, Cu, Cr, Al, Mo, Au, Nb, Te and the like, these alloys or amorphous metals and the like. Said electrically insulating material includes films or sheets of synthetic resins such as polyester, polyethyrene, polyimide and the like, glass, ceramics and the like. When using the electrically insulating material, it is necessary that one surface thereof has been subjected to conductive treatment. The conductive treatment is carried out in the manner of attaching the thin film of said electrically conductive material to the electrically insulating material, or attaching a transparent electrically conductive film comprising an oxide such as ITO, $SnO_2$ or the like to the electrically insulating material, or attaching a silicide film containing Cr, In or the like to the electrically insulating material. The formation of this thin films can be effected by vacuum vapordeposition, spattering, CVD method, ion plating method, or the like.

The substrate 11 may take an optional shape such as cylindrical belt-like, plate-like or the like.

Figure 5:
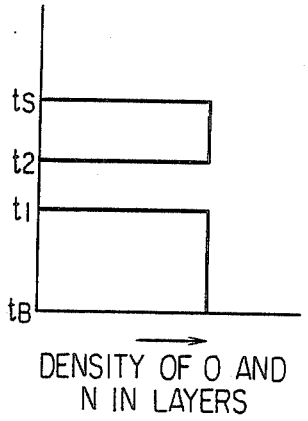
FIG. 5, FIG. 6 and FIG. 7 are typical views showing the concentrations of oxygen and nitrogen atoms added in layers.

The charge transfer layer 31, the first charge carrier generating layer 33 and the second charge carrier generating layer 35 each comprises an a-Si layer consisted mainly of Si atoms and containing hydrogen atoms, heavy hydrogen atoms or halogen atoms. The charge transfer layer 31 and the second charge carrier generating layer 35 each has an optical forbidden band (band gap) larger than that of the first charge carrier generating layer 33. This optical forbidden band may be controlled for instance in the manner of making the a-Si layer incorporate oxygen and nitrogen therein. FIG. 5 is a graph showing the distribution concentrations of oxygen and nitrogen in the direction of thickness of the photosensitive layer 13. It can be seen therefrom that the charge transfer layers ($t_B-t_1$) 31 and the second charge carrier generating layers ($t_2-t_s$) 35 have realized optical forbidden bands larger than those of the first charge carrier generating layers 33 by increasing the concentrations of oxygen and nitrogen more than those of the first charge carrier generating layers ($t_1-t_z$) 33.

Figure 6:
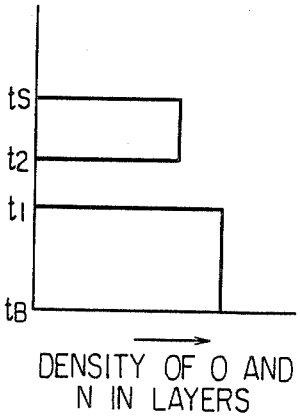
Figure 7:
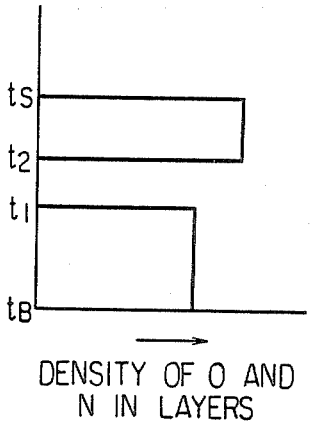

FIG. 6 shows a constitutional example wherein larger amounts of nitrogen atoms have been contained in the charge transfer layers ($t_B-t_1$) 31 with the intention of improving the charged potential. As shown in FIG. 7, it is also possible to make the charge transfer layers ($t_B-t_1$) 31 contain smaller amounts of nitrogen atoms and oxygen atoms with the intention of improving the sensitivity.

It is preferable that the charge transfer layer 31 should have an optical forbidden band of 1.8 eV or more, and have such a photosensitivy that the $\sigma p/\sigma d$ under AM1-100mW/cm$^2$ light is $1\times10^3$ or more, wherein $\sigma p$ stands for a light electric conductivity and $\sigma d$ stands for a dark electric conductivity.

The charge transfer layer 31 is an a-Si layer containing (a) silicon atoms, (b) at least one member of hydrogen atoms, heavy hydrogen atoms and halogen atoms (which is abridged H), (c) oxygen atoms and (d) nitrogen atoms. Preferable percentages of respective atoms in the charge transfer layer 31 are as given blow.

Si atoms: 30–95 atomic %
(preferably, 55–90 atomic %)
H atoms: 5–30 atomic %
(preferably, 10–20 atomic %)
O atoms: 0.1–30 atomic %
(preferably, 1–20 atomic %)
N atoms: 0.01–10 atomic %
(preferably 0.1–5 atomic %)

This charge transfer layer 31 normally has a n-conduction type, but may have an i-conduction type by doping Group III atoms of the Periodic Table. As the Group III atoms there are used B, Al, Ga, In and the like. It is preferable to dope $10^{-6}-10^{-3}$ atomic % of said Group III atoms in the charge transfer layer 31, more preferably $10^{-5}-10^{-4}$atomic % of said Group III atoms.

The thickness of the charge transfer layer 31 suitably is about 5–50 μm. and preferably is about 8–40 μm.

In the charge transfer layer 31, furthermore, it is applicable for the purpose of improving the effect of obstructing free carriers to form one more layer on the substrate 11 side by the use of an insulating material that is more resistant than said charge transfer layer, a photoconductive material, a non-photoconductive material or the like, and to make the function of aforesaid electric characteristics exist within the charge transfer layer 31 by the use of the same material as the thus formed one more layer.

The charge transfer layer like this may be formed by means of known methods such as glow discharge method, spattering method, ion plating method and the like. The glow discharge method is particularly profitable.

As the raw gases used for film formation according to the glow discharge method, there may be enumerated silicon hydride (silane) gases such as $SiH_4$, $Si_2H_6$, $Si_3H_8$, $Si_4H_{10}$ and the like having Si and H described in for instance Japanese Laid-open Patent Application No. 115553/1982 Specification as constituent atoms; silicon halide gases such as $SiF_4$, $Si_2F_6$, $SiCl_4$, $SiCl_3Br$, $SiCl_2Br_2$, $SiClBr_3$, $SiCl_3I$, $SiBr_4$ and the like having Si and halogen as constituent atoms; and halogen-substituted silicon hydride gases such as $SiH_2F_2$, $SiH_2Cl_2$, $SiHCl_3$, $SiH_3Cl$, $SiH_3Br$, $SiH_2Br_2$, $SiHBr_3$ and the like having Si, halogen and hydrogen as constituent atoms.

As the starting materials for oxygen atoms and nitrogen atoms contained as filling materials in the charge transfer layer 31 there may be used those described likewise in Japanese Laid-open Patent Application No. 115553/1982 Specification.

That is, as the starting gases for oxygen atoms there may be enumerated $O_2$, $O_3$, CO, $CO_2$, NO, $NO_2$, $N_2O$, $N_2O_3$, $N_2O_4$, $N_2O_5$ and the like, and as the starting gases for nitrogen atoms there may be enumerated $N_2$ and $NH_3$. As the doping gases there may be enumerated organic metallic compounds such as $B_2H_6$, $Al(CH_3)_3$, $Ga(CH_3)_3$, $In(CH_3)_3$ and the like, chlorides of Al, Ga, In, Tl and the like.

The first charge carrier generating layer 33 preferable comprises an a-Si layer consisting mainly of silicon atoms and contains at least one member of hydrogen atoms, heavy hydrogen atoms or halogen atoms as constituent atoms, and has an optical forbidden band of about 1.6–1.8 eV. The first charge carrier generating layer 33 functions to subject an incident light on the long wavelength side to photoelectric conversion effectively and transfer photocarriers (hole, electron) to another layer without being trapped within the first charge carrier generating layer 33. Referring to the spectral sensitivity characteristic of the first charge carrier generating layer 33 alone, it is most sensitive to the wavelength region of 600 nm–700 nm.

It is desirable that the first charge carrier generating layer should contain the respective atoms in the following percentages:

Si atoms: 60–95 atomic %
(preferably 70–90 atomic %)
H atoms: 5–40 atomic %
(preferably 10–30 atomic %).

Further, it is possible to dope the atoms coming under Group III or V of the periodic Table.

The thickness of the first charge carrier generating layer 33 properly is about 0.05–5 μm, and preferably is about 0.1–3 μm. The first charge carrier generating layer 33 may be formed in the same manner as the charge transfer layer 31.

The second charge carrier generating layer 35 comprises an a-Si layer consisting mainly of silicon atoms, contains at least one member selected from the group consisting of hydrogen atoms, heavy hydrogen atoms or halogen atoms as constituent atoms, and further contains oxygen atoms and nitrogen atoms. The second charge carrier generating layer 35 preferably has an optical forbidden band gap of 1.9eV or more, and suitably has the $\sigma p/\sigma d$ of $1\times10^3$ or more under AM1-100mW/cm$^2$ light.

The second charge carrier generating 35 functions to subject an incident light on the short wavelength side to photoelectric conversion effectively, transfer photocarriers without being trapped within the layer, and further hold the electric charge electrified on the surface by corona discharge or the like on the surface without being injected into the layer. Referring to the spectral sensitivity characteristic of the second charge carrier generating layer 35 alone, it is most sensitive to the wavelength region of 450nm–600nm.

It is desirable that thye second charge carrier generating layer should contain the respective constituent atoms therein in the following percentages:

Si atoms: 10–95 atomic %
(preferably 35–90 atomic %)
H atoms: 5–30 atomic %
(preferably 10–20 atomic %)
O atoms: 0.5–40 atomic %
(preferably 1–30 atomic %)
N atoms: 0.1–20 atomic %
(preferably 0.5–15 atomic %)

The above explanation was made with reference to the case where the added element is distributed with a uniform concentration in the direction of thickness of each layer, but is should not be limited thereto.

For instance, the oxygen atoms and nitrogen atoms contained in the charge transfer layer 31 are normally distributed uniformly in the direction of film. In order to improve the adherence onto the surface of the substrate 11 and prevent the injection of free carriers from the substrate 11, however, there may be employed such a distribution being not uniform in the direction of layer that these atoms are contained much more on the substrate 11 side. Further, the atoms coming under Group III of the Periodic Table also normally indicate the distribution being uniform in the direction of film as well as uniform in the direction of layer. In order to prevent the injection of free carriers from the substrate 11, however, there may be employed such a distribution being not uniform in the direction of layer that said atoms coming under Group III of the Periodic Table are contained much more on the substrate 11 side.

In the second charge carrier generating layer 35, furthermore, it is applicable for the purpose of increasing the effect of holding the electrified charge to form one more layer on the film surface by the use of an insulating material that is more resistant than the second charge carrier generating layer, a photoconductive material, a non-photoconductive material or the like, and to make the above effect exist within the second charge carrier generating layer 35 by the use of the same material as the thus formed one more layer.

In addition, it is possible to make the second charge carrier generating layer 35 contain the atoms coming under Group III of the Periodic Table or the atoms coming under Group V of the Periodic Table in order to hold the charge electrified on the surface in situ without being injected in the film. This filling material (Group III atom or Group V atom) is added uniformly in the direction of film and is normally distributed uniformly in the direction of layer. If necessary, however, said atoms may be distributed much more on the surface in order to enhance the effect of preventing injection.

The thickness of the second charge carrier generating layer 35 desirably is about 0.05–10 μm, and preferably is about 0.1–5 μm. The second charge carrier generating layer 35 may be formed in the same manner as the charge transfer layer.

As shown in FIG. 5, FIG. 6 and FIG. 7, process control of electric characteristics may be made in the wide region of the electrophotographic photosensitive material by changing the contents of oxygen atoms and nitrogen atoms in the film.

Further, the photosensitiveity may be increased and the residual potential may be decreased by making the energy amounts ($E_F-E_v$) from the band end of the valence band to the Fermi level substantially equal throughout three layers, namely the charge transfer layer 31, the first charge carrier generating layer 33 and the second charge carrier generating layer 35. This energy control can be made by controlling the contents of oxygen and nitrogen in the charge transfer layer 31 and the second charge carrier generating layer 35. The energy amounts ($E_F-E_v$) of the charge transfer layer and the second charge carrier generating layer can be controlled by adjusting the amounts of oxygen and nitrogen because the energy levels of oxygen atoms and nitrogen atoms in the bands are different. The optimum $E_F-E_v$ in the first charge carrier generating layer is settled, and then the charge transfer layer and the second charge carrier generating layer are each arranged to have values being even with said optimum ones by regulating the amounts of oxygen and nitrogen. The $E_F-E_v$ of the first charge carrier generating layer can be settled by the amount of hydrogen, and preferably is about 1.0–1.2 eV.

In the above construction example there is shown the case where the charge transfer layer, the first charge carrier generating layer and the second charge carrier generating layer each comprises an a-Si layer. The photoconductive semi-conductor materials should not be limited thereto. As said materials there may be used for instance Si, Se, SeTe, CdS and the like taking the shapes from amorphous to crystal.

It is also applicable for the purpose of preventing the injection of free carriers from the substrate to form a barrier layer between the substrate and the photosensitive layer by means of a photoconductive material or insulating material being superior in resistance to the photosensitive layer or form another undercoat layer or intermediate layer. It is also possible to form a layer comprising a more high resistant photoconductive or insulating material on the photosensitive layer for improving the effect of holding the electrified charge, and form a protective layer on the photosensitive layer.

EFFECT OF THE INVENTION

The present invention gives an electrophotographic photosensitive material superior in both photosensitivity and charging characteristics by having a photosensitive layer of three layers such as a charge transfer layer, a first charge carrier generating layer and a second charge carrier generating layer and making each of the charge transfer layer and the second charge carrier generating layer have a band gap larger than that of the first charge carrier generating layer.

Further, the present invention gives an electrophotographic photosensitive material superior in both sensitivity and charging characteristics by forming a charge transfer layer, a first charge carrier generating layer and a second charge carrier generating layer from a-Si layers containing at least one member of hydrogen atoms, heavy hydrogen atoms and halogen atoms, and further by adding oxygen atoms and nitrogen atoms to the charge transfer layer and the second charge carrier generating layer so as to exhibit the characteristics of the a-Si layer to the full.

According to the present invention, still further, the photosensitivity can be further enhanced as well as improving the residual potential characteristics, by substantially equalizing the total energies from the band end of the valence band to the Fermi level in the direction of thickness of the photosensitive layer, and so when the electrification-exposure process is applied repeatedly there can be maintained a high image quality.

EXAMPLES

Example 1

Figure 8:
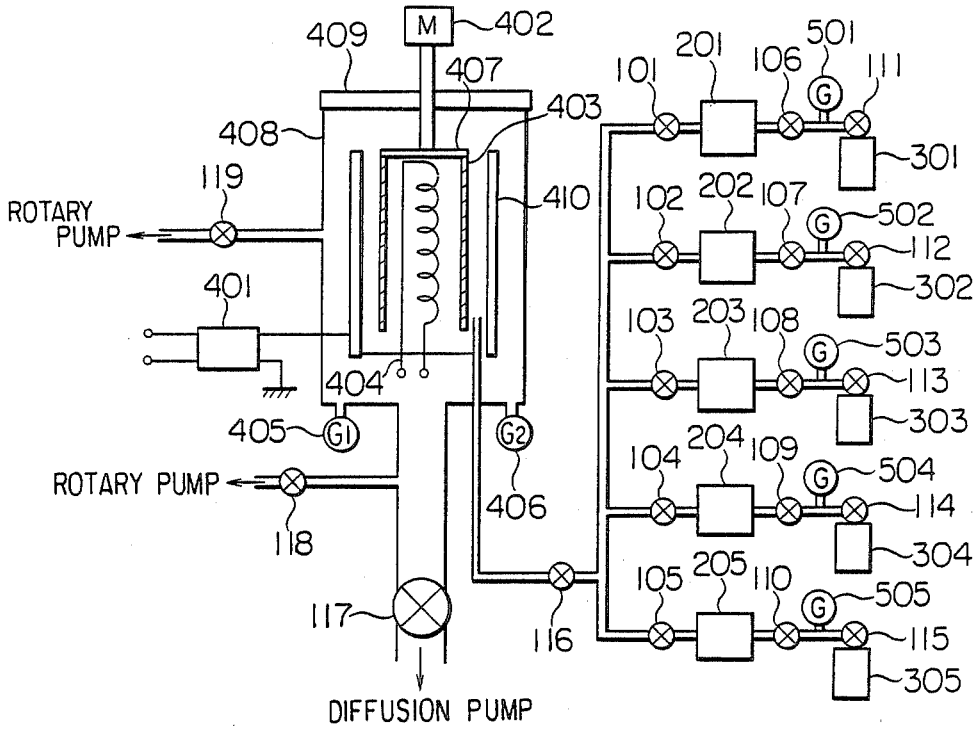
FIG. 8 is a schematic view showing an apparatus for producing the photosensitive material for electrophotography according to the present invention.
Figure 11:
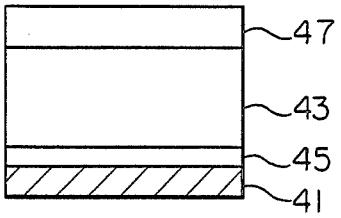
FIG. 11 and FIG. 12 are sectional views showing the layer structure of conventional electrophotographic photosensitive materials.
Figure 12:
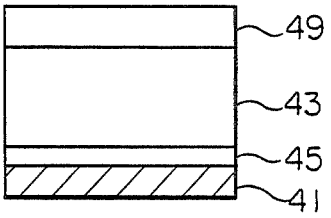

An a-Si system electrophotographic photosensitive material as shown in FIG. 4 was prepared by using the apparatus shown in FIG. 8 and according to the following operations (i)-(ix).

(i) A drum-shaped aluminum substrate (diameter 120 mmϕ; length 300 mm) 403 having a cleansed surface was secured to a fixing means 407. Said aluminum substrate, said fixing means 407, and a vacuum cover 409 to which a motor 402 for rotating the substrate was attached, were positioned on a chamber body 408. Thereafter, a roughing valve 118 was opened to hold said chamber 408 so that a diaphragm type vacuum gauge 405 indicated the degree of vacuum of about $1\times10^{-2}$ Torr.

(ii) The substrate 403 was rotated by means of the motor 402, and the aluminum substrate 403 was heated by means of a heater 404 to thereby maintain the substrate temperature at 300° C.

(iii) Gas valves 116, 101, 102, 103, 104, 105, 106, 107, 108, 109 and 110, and mass flow controllers 201, 202, 203, 204 and 205 were full-opened to thereby hold the chamber 408 so that the diaphragm type vacuum gauge 405 might indicate the degree of vacuum in the gas line of about $1\times10^{-2}$ Torr. Thereafter, the roughing valve 118 was closed, the main valve 117 was opened, and the vacuum chamber and the gas line were suctioned to the full by means of a diffusion pump so that an ionization vacuum gauge 406 indicated the degree of vacuum of $1\times10^{-6}$ Torr. After deairing, the heater 404 was adjusted, and the temperative of the substrate was accurately controlled to be about 200° C.+1° C.

(iv) After the substrate temperature was stabilized, the main valve 117 was closed, then gas valves 116, 101, 102, 103, 104, 105, 106, 107, 108, 109 and 110 were closed, and further mass flow controllers 201, 202, 203 and 205 were wholly closed.

(v) A valve 112 of an Ar gas (purity 99.999) bomb was opened, an output pressure gauge 502 was adjusted to be 1 Kg/cm$^2$, gas valves 116, 102 and 107 were opened slowly to set the flow rate of mass flow controller to be 320 SCCM, an auxiliary valve 119 was opened so that the diaphragm type vacuum gauge 405 within the chamber might indicate the degree of vacuum of 0.7 Torr, and suction was effected by means of a rotary pump attached to the outlet of said auxiliary valve.

(vi) A valve 111 of a $SiH_4$ gas (purity 99.999) bomb was opened, an output pressure gauge 501 was adjusted to be 1 Kg/cm$^2$, gas valves 101 and 106 were opened slowly to set the flow rate of mass flow controller to be 80 SCCM, and same was introduced into the chamber so as to satisfy $SiH_4/Ar=0.8$.

(vii) A valve 113 of a $CO_2$ gas (purity 99.999) bomb was opened so as to adjust an output pressure gauge 503 to be 1 Kg/cm$^2$, a valve 114 of a $N_2$ gas (purity 99.999) bomb was opened so as to adjust an output pressure gauge 504 to be 1 Kg/cm$^2$, then a valve 115 of a $B_2H_6$ gas (100 ppm based on Ar) bomb was opened so as to adjust an output pressure gauge to be 1 Kg/cm$^2$, gas valves 103, 104, 105, 108, 109 and 110 were opened so that mass flow controllers 203, 204 and 205 might satisfy $CO_2/N_2=0.1$, $SiH_4/N_2=1$ and $B_2H_6/SiH_4=10^{-6}$, and finally the auxiliary valve 119 was adjusted so as to maintain the pressure within the chamber to be about 1 Torr.

(viii) After the pressure within the chamber had been stabilized, a high frequency electric power of 13.56 MHz 75 W was introduced from a high frequency power source 401 between a high frequency electrode 410 and the substrate 403 to thereby form about a 19 μm-thick charge transfer layer by the grow discharge method.

(ix) The high frequency power source was cut, and the gas valves 103, 104 and 105 were closed. After the lapse of a time sufficient to suck $CO_2$ gas, $N_2$ gas and $B_2H_6$ gas from within the chamber by a rotary pump, the auxiliary valve 119 was adjusted to hold the pressure within the chamber at 1 Torr, the high frequency power source was on when the high frequency electric power was 75W, and an about a 1 μm-thick first charge carrier generating layer was formed by the grow discharge method.

(x) Then, the high frequency power source was cut, gas valves 103, 104 and 105 were opened, the mass flow controller was adjusted to satisfy $CO_2/N_2=0.1$, $SiH_4/N_2=1$ and $B_2H_6/SiH_4=10^{-6}$, the anxially valve 119 was adjusted to hold the pressure within the chamber at 1 Torr, after the pressure within the chamber had been stabilized the high frequency power source was on when the high frequency electric power was 75 W, and an about 200 Å-thick second charge carrier generating layer was formed by the grow discharge method.

(xi) Further, the high frequency power source was cut, gas valves 101, 102, 103, 104, 105, 106, 107, 108, 109, 110 and 116 were closed, the anxiliary valve 119 was fully, the heater was cut when the diaphragm type vacuum gauge indicated $1\times10^{-2}$ Torr, and cooled gradually. When the Al substrate temperature cooled to a normal temperature, gas valves 116, 104 and 109 were opened. $N_2$ gas flowed so that the degree of vacuum might become about 2 Torr, and the chamber was purged.

After the chamber had been purged to the full, gas valves 116, 104 and 109 were closed, and an electrophotographic photosensitive material drum was taken out from the fixing means 407 upon confirming that the degree of vacuum had become $1\times10^{-2}$ Torr.

Figure 9:
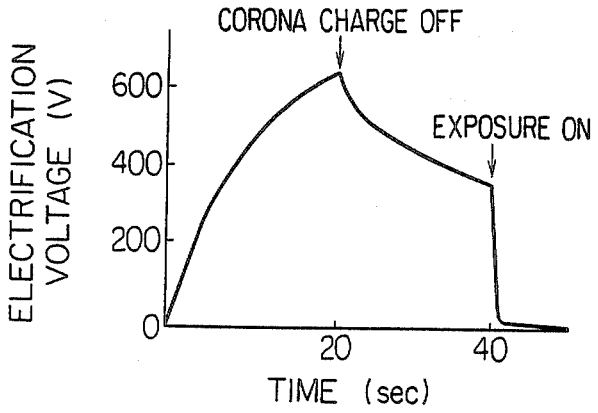
FIG. 9 is a graph showing the chargeability of the photosensitive material for electrophotography according to the present invention.

The electric characteristic of the thus prepared a-Si system electrophotographic photosensitive material drum was as shown in FIG. 9. When this electrophotographic photosensitive material was subjected to +5 KV corona discharge, it displayed a superior charged potential of 600 V. Under the radiation from a tungsten lamp (color temperature 2854° K., 95 lux), it displayed that the time required half decay of the charged potential was 0.26 sec. In other words, this electrophotographic photosensitive material was proved to have a sensitivity more than 10 times of that of the conventional Se or CdS system electrophotographic photosensitive material.

Figure 10:
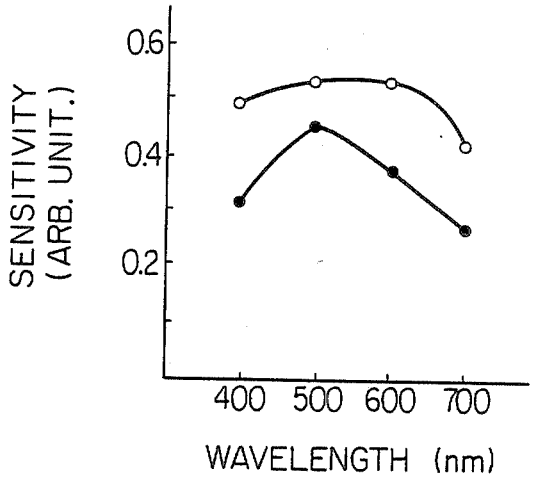
FIG. 10 is a graph showing the spectral sensitivity of the photosensitive material for electrophotography according to the present invention.

Further, FIG. 10 shows the spectral sensitivity of the electrophotographic photosensitive material according to the present invention that has the property of sensitizing the short wavelength. In FIG. 7 ○ denotes the spectral sensitivity realized by the electrophotographic photosensitive material according to the present invention, while ● denotes the spectral sensitivity obtained from the oxygen atom alone-added amorphous silicon monolayer type electrophotographic photosensitive material. It can be clearly seen that the electrophotographic photosensitive material according to the present invention has property of sensitizing the short wavelength.

This photosensitive material for electrophotography was actually set in a copying machine for the purpose of forming an image. The obtained image was judged to be a high quality transfer toner image.

Example 2

A photosensitive material for electrophography was prepared according to the same procedure as Example 1. As the starting gases for oxygen atoms and nitrogen atoms in the charge transfer layer and the second charge carrier generating layer there were used various kinds of starting gases. The thus obtained sensitivity, charged potential and image quality are shown in Table-1.

TABLE 1

| Sample No. | Starting gas for O atom | Starting gas for N atom | Starting gas for O atom/starting gas for N atom | Starting gas for $SiH_4$/N atom | Sensitivity | Charged potential | Image quality |
|---|---|---|---|---|---|---|---|
| 1-1 | $CO_2$ | $N_2$ | 0.1 | 1 | ◎ | ◎ | ◎ |
| 1-2 | $O_2$ | $N_2$ | 0.1 | 1 | ○ | ◎ | ○ |
| 1-3 | CO | $N_2$ | 0.2 | 1 | ○ | ○ | ○ |
| 1-4 | $NO_2$ | $N_2$ | 0.1 | 1 | ◎ | ◎ | ◎ |
| 1-5 | $N_2O$ | $N_2$ | 0.2 | 1 | ○ | ◎ | ◎ |
| 1-6 | $CO_2$ | $NH_3$ | 0.5 | 0.5 | ◎ | ◎ | ◎ |
| 1-7 | $O_2$ | $NH_3$ | 0.3 | 0.5 | ○ | ○ | ○ |

Note ◎ denotes especially good and ○ denotes good

Example 3

A photosensitive material for electrophotography was prepared according to the same procedure as Example 1. At the time, the amounts of starting gases were changed so as to change the amounts of nitrogen atoms and oxygen atoms in the charge transfer layer and the second charge carrier generating layer. The thus obtained sensitivity, charged potential and image quality are shown in Table 2.

TABLE 2

| Sample No. | Charge transfer layer: Starting gas for O atom/starting gas for N atom | Charge transfer layer: Starting gas for $SiH_4$/N atom | Second charge carrier generating layer: Starting gas for O atom/Starting gas for N atom | Second charge carrier generating layer: Starting gas for $SiH_4$/N atom | Evaluation: Sensitivity | Evaluation: Charged potential | Evaluation: Image quality |
|---|---|---|---|---|---|---|---|
| 2-1 | $CO_2/N_2 = 0.1$ | $SiH_4/N_2 = 1$ | $CO_2/N_2 = 0.1$ | $SiH_4/N_2 = 1$ | ◎ | ◎ | ◎ |
| 2-2 | $CO_2/N_2 = 0.2$ | $SiH_4/N_2 = 0.8$ | $CO_2/N_2 = 0.1$ | $SiH_4/N_2 = 1$ | ◎ | ○ | ○ |
| 2-3 | $CO_2/N_2 = 0.1$ | $SiH_4/N_2 = 1$ | $CO_2/N_2 = 0.2$ | $SiH_4/N_2 = 0.8$ | ○ | ◎ | ○ |
| 2-4 | $O_2/N_2 = 0.05$ | $SiH_4/N_2 = 1$ | $O_2/N_2 = 0.1$ | $SiH_4/N_2 = 1$ | ◎ | ○ | ○ |

Note ◎ denotes especially good and ○ denotes good.

Example 4

A photosensitive material for electrophotography was prepared according to the same procedure as Example 1. At this time, the $B_2H_6/SiH_4$ ratio was changed in order to add B as Group III atoms added to the charge transfer layer and the second charge carrier generating layer. The thus obtained sensitivity, charged potential and image quality are shown in Table-3. The flow rate of $B_2H_6$ was arranged to be equal in the charge transfer layer and the second charge carrier generating layer.

TABLE 3

| Sample No. | $B_2H_6/SiH_4$ flow rate ratio | Sensitivity | Charged potential | Image quality |
|---|---|---|---|---|
| 3-1 | $1 \times 10^{-6}$ | ○ | Δ | Δ |
| 3-2 | $5 \times 10^{-6}$ | ○ | ○ | ○ |
| 3-3 | $1 \times 10^{-5}$ | ◎ | ◎ | ◎ |
| 3-4 | $5 \times 10^{-5}$ | ◎ | ○ | ○ |
| 3-5 | $1 \times 10^{-4}$ | ○ | Δ | ○ |
| 3-6 | $5 \times 10^{-4}$ | ○ | X | X |
| 3-7 | $1 \times 10^{-3}$ | X | X | X |
| 3-8 | $5 \times 10^{3}$ | X | X | X |

Note
◎ denotes especially good, ○ denotes good,
Δ denotes fit for practical used and
X denotes unfit for use respectively.

Example 5

Photosensitive materials for electrophotography were prepared according to the same procedure as Example 1 except that the $CO_2$ and $N_2$ amounts for forming the charge transfer layer and the second charge carrier generating layer were changed in the range of $CO_2/N_2=0.005-10$ ( in the case of the charge transfer layer) and in the range of $CO_2/N_2=0.05-30$ (in the case of the second charge carrier generating layer) and combined and thus the optical forbidden band gap and the activation energy from the valence band side were adjusted. These photosensitive materials were measured in respect of the sensitivity according to the same procedure as Example 1, and were evaluated in respect of the residual potential resulting from their repetition use according to the undermentioned method.

Evaluation of residual potential

Electrification and exposure were repeated 100 times. The residual potential after 100 times was calculated and evaluated on the following standards:

◎: 0–10 bolts
○: 10–30 bolts
Δ: 30–50 bolts
X: 50 bolts or more

The above results were summarized in Table-4. The bridge symbols in Table-4 are as stated below.

Eg : band gap (eV)

$E_F - E_V$: energy (eV) from the band end of the valence band to the Fermi level $\sigma p/\sigma d$: dark conductivity $\sigma d$/bright conductivity $\sigma p$ (bright conductivity was measured under an amount of light of AMI 100mW/cm$^2$.)

TABLE 4

| Sample No. | Charge transfer layer Eg (eV) | $E_F$-Ev (eV) | $\sigma p/\sigma d$ | First charge carrier generating layer Eg (eV) | $E_F$-Ev (eV) | $\sigma p/\sigma d$ | Second charge carrier generating layer Eg (eV) | $E_F$-Ev (eV) | $\sigma p/\sigma d$ | Evaluation Sensitivity | Residual potential |
|---|---|---|---|---|---|---|---|---|---|---|---|
| 4-1 | 2.0 | 0.8 | $4 \times 10^5$ | 1.7 | 1.0 | $1 \times 10^4$ | 1.8 | 0.8 | $4 \times 10^5$ | ○ | Δ |
| 4-2 | 2.1 | 0.9 | $6 \times 10^6$ | 1,7 | 1.0 | $1 \times 10^4$ | 2.0 | 0.8 | $4 \times 10^5$ | ⊙ | ○ |
| 4-3 | 2.2 | 1.0 | $3 \times 10^6$ | 1.7 | 1.0 | $1 \times 10^4$ | 2.2 | 1.0 | $3 \times 10^6$ | ⊙ | ⊙ |
| 4-4 | 2.3 | 1.1 | $2 \times 10^6$ | 1.7 | 1.0 | $1 \times 10^4$ | 2.4 | 1.2 | $5 \times 10^5$ | ○ | Δ |
| 4-5 | 2.4 | 1.2 | $5 \times 10^5$ | 1.7 | 1.0 | $1 \times 10^4$ | 2.6 | 1.4 | $1 \times 10^5$ | ○ | X |

What is claimed is:

1. A photosensitive material for electrophotography that comprises a photosensitive layer on an electrically conductive substrate or on an electrically conductive layer provided on a electrically non-conductive substrate, wherein said photosensitive layer consists essentially of three layers, (1) a charge transfer layer provided on said conductive substrate or on said conductive layer provided on said non-conductive substrate, (2) a first charge carrier generating layer provided on said charge transfer layer and (3) a second charge carrier generating layer provided on said first charge carrier generating layer, said charge transfer layer and second charge carrier generating layer each having a band gap wider than that of said first charge carrier generating layer, said first charge carrier generating layer being photosensitive to radiation having a relatively long wavelength and said second charge carrier generating layer being photosensitive to radiation having a relatively short wavelength.

2. A photosensitive material for electrophotography according to claim 1, wherein the optical forbidden band gap of said charge transfer layer is 1.8 eV or more.

3. A photosensitive material for electrophotography according to claim 1, wherein the thickness of said charge transfer layer is 5–50 μm.

4. A photosensitive material for electrophotography according to claim 1, wherein the optical forbidden band gap of said first charge carrier generating layer is 1.6–1.8 eV.

5. A photosensitive material for electrophotography according to claim 1, wherein the thickness of said first charge carrier generating layer is 0.05–5 μm.

6. A photosensitive material for electrophotography according to claim 1, wherein the optical forbidden band gap of said second charge carrier generating layer is 1.9 eV or more.

7. A photosensitive material for electrophotography according to claim 1, wherein the thickness of said second charge carrier generating layer is 0.05–10 μm.

8. A photosensitive material for electrophotography according to claim 1, wherein the band gap of said each layer is constructed to have a substantially equal energy from the band end the valence band to the Fermi level.

9. A photosensitive material for electrophotography according to claim 1, wherein said charge transfer layer, first charge carrier generating layer and second charge carrier generating layer are each formed of a noncrystalline silicon layer that contains at least one member selected from the group consisting of hydrogen atoms, heavy hydrogen atoms or halogen atoms, is constructed of a noncrystalline material that consists mainly of silicon atoms and exhibits photoconductivity, and the charge transfer layer and the second charge carrier generating layer further contains oxygen atoms and nitrogen atoms as constituent atoms.

10. A photosensitive material for electrophotography according to claim 9, wherein said charge transfer layer contains the respective atoms in the following percentages:

Si atoms: 30–95 atomic %
H atoms: 5–30 atomic %
O atoms: 0.1–30 atomic %
N atoms: 0.01–10 atomic %.

11. A photosensitive material for electrophotography according to claim 9, wherein said first charge carrier generating layer contains the respective atoms in the following percentages:

Si atoms: 60–95 atomic %
H atoms: 5–40 atomic %.

12. A photosensitive material for electrophotography according to claim 9, wherein said second charge carrier generating layer contains the respective atoms in the following percentages:

Si atoms: 10–95 atomic %
H atoms: 5–30 atomic %
O atoms: 0.5–40 atomic %
N atoms: 0.1–20 atomic %

* * * * *

UNITED STATES PATENT AND TRADEMARK OFFICE

CERTIFICATE OF CORRECTION

PATENT NO. : 4 734 346

DATED : March 29, 1988

INVENTOR(S) : Masafumi KUMANO et al

It is certified that error appears in the above-identified patent and that said Letters Patent is hereby corrected as shown below:

Column 16, line 20; after "end" insert ---of---.

Signed and Sealed this

Twenty-fifth Day of October, 1988

*Attest:*

*Attesting Officer*

DONALD J. QUIGG

*Commissioner of Patents and Trademarks*